US007773891B2

(12) United States Patent
Toh et al.

(10) Patent No.: US 7,773,891 B2
(45) Date of Patent: Aug. 10, 2010

(54) SYSTEM AND METHOD FOR DETERMINING VOLUME OF AN IMAGING MEDIUM IN A CARTRIDGE

(75) Inventors: Cher Lek Toh, Singapore (SG); Sandeep Kumar Arya, Northvale (SG); Loo Shing Tan, Singapore (SG)

(73) Assignee: Dell Products L.P., Round Rock, TX (US)

( * ) Notice: Subject to any disclaimer, the term of this patent is extended or adjusted under 35 U.S.C. 154(b) by 490 days.

(21) Appl. No.: 11/868,582

(22) Filed: Oct. 8, 2007

(65) Prior Publication Data

US 2009/0090878 A1 Apr. 9, 2009

(51) Int. Cl.
*G03G 15/08* (2006.01)

(52) U.S. Cl. ..... 399/27; 399/61; 399/111

(58) Field of Classification Search ..... 399/24, 399/25, 27–30, 58, 61–64, 111
See application file for complete search history.

(56) References Cited

U.S. PATENT DOCUMENTS

| | | | | |
|---|---|---|---|---|
| 5,216,462 | A | 6/1993 | Nakajima et al. | 355/203 |
| 5,893,007 | A * | 4/1999 | Lim | 399/13 |
| 5,899,597 | A | 5/1999 | Shinohara et al. | 399/64 |
| 6,041,196 | A * | 3/2000 | Nakagawa et al. | 399/27 |
| 6,246,841 | B1 | 6/2001 | Merrifield et al. | 399/27 |
| 6,274,880 | B1 | 8/2001 | Walker | 250/577 |
| 6,445,888 | B1 * | 9/2002 | Fujiwara et al. | 399/27 |
| 6,456,802 | B1 | 9/2002 | Phillips | 399/27 |
| 2001/0035887 | A1 | 11/2001 | Altfather et al. | 347/7 |
| 2007/0296780 | A1 | 12/2007 | Jones | 347/88 |

FOREIGN PATENT DOCUMENTS

JP 2005338342 A 8/2005

OTHER PUBLICATIONS

Singapore Search Report for Application No. 200802182-6, 8 pages.

* cited by examiner

*Primary Examiner*—David P Porta
*Assistant Examiner*—Benjamin Schmitt
(74) *Attorney, Agent, or Firm*—Baker Botts L.L.P.

(57) ABSTRACT

Systems and methods for determining the volume of imaging medium in a cartridge are disclosed. An imaging medium may include a movable housing portion and a device coupled to the movable housing portion. The movable housing portion may include a volume of imaging medium and may be configured to move in response to changes in the volume of imaging medium in the movable housing portion. The device may be configured to project a beam of electromagnetic energy onto a location of a beam-receiving photodetector, the beam-receiving location moving in response to movement of the movable housing portion such that the beam-receiving location is based at least on the volume of imaging medium on the movable housing portion.

20 Claims, 2 Drawing Sheets

SYSTEM AND METHOD FOR DETERMINING VOLUME OF AN IMAGING MEDIUM IN A CARTRIDGE

TECHNICAL FIELD

The present disclosure relates in general to imaging apparatuses, and more particularly to determining the volume of an imaging medium in a cartridge used in an imaging apparatus.

BACKGROUND

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Imaging apparatuses, for example printers, copiers, and facsimile machines, are often used alone and/or in combination with information handling systems to print latent images (e.g., text and/or pictures) on a recording medium (e.g., paper, transparencies, and/or any other suitable medium) using an imaging medium (e.g., toner, ink, and/or other suitable medium). Modern imaging apparatuses may include, without limitation, toner-based imaging apparatuses and inkjet imaging apparatuses.

A toner-based imaging apparatus may use a laser, light-emitting diode (LED), and/or other suitable electromagnetic energy source to sensitize selected regions of a photoconductive drum. Charged toner particles may adhere to the selected regions of the photoconductive drum, and then may be transferred from the drum to the recording medium. The toner particles may be fused to the recording medium with heat and/or pressure.

On the other hand, an inkjet imaging apparatus may use a spray nozzle to spray small, precise droplets of ink onto a recordable medium. Often, the droplets may carry a slight electrical charge. Accordingly, the placement of a droplet on the recording medium may be determined by the charge of a cathode and electrode between which the droplet moves toward the recording medium.

The imaging medium (e.g., toner, ink, and/or other suitable medium) used in an imaging apparatus may be supplied from a cartridge, which may also be known as a "toner cartridge" or "ink cartridge" depending on the imaging medium used. In some instances, an imaging medium cartridge may comprise one or more disposable portions that may be discarded and/or replaced after the volume of imaging medium in the cartridge has been substantially depleted from use.

Because the volume of imaging medium in a cartridge may be depleted over time, it is often necessary to gauge the remaining volume of imaging medium and convey such information to a user, so that the user may replace a substantially depleted cartridge. However, conventional approaches for determining the volume of remaining imaging medium in a cartridge are often inaccurate, particularly in toner cartridges used in toner-based imaging apparatuses. Accordingly, due to these inaccuracies, imaging medium cartridge manufacturers may often "overfill" the cartridges with more imaging medium than the stated volume in order to maintain customer satisfaction. Because of this "overfill," cartridge manufacturers may experience revenue loss proportional to the amount of overfilling.

One approach to determine the volume of remaining toner in a toner cartridge uses a load cell to measure the weight of toner remaining in the cartridge, as discussed in U.S. Pat. No. 6,246,841. However, this approach requires a load cell and corresponding circuitry to measure the toner weight, and thus may be prohibitively expensive for many applications.

Another approach uses "pixel counting," which includes determining the number of pixels printing on a recording medium, in order to determine the volume of toner remaining, as discussed in U.S. Pat. No. 6,456,802. However, this approach may be inaccurate due to indeterminable flow characteristics of toner in a cartridge.

SUMMARY

In accordance with the teachings of the present disclosure, the disadvantages and problems associated with determining the volume of imaging medium in a cartridge have been substantially reduced or eliminated.

In accordance with one embodiment of the present disclosure an imaging medium may include a movable housing portion and a device coupled to the movable housing portion. The movable housing portion may include a volume of imaging medium and may be configured to move in response to changes in the volume of imaging medium in the movable housing portion. The device may be configured to project a beam of electromagnetic energy onto a location of a beam-receiving photodetector, the beam-receiving location moving in response to movement of the movable housing portion such that the beam-receiving location is based at least on the volume of imaging medium on the movable housing portion.

In accordance with another embodiment of the present disclosure, an imaging apparatus may include a body, an electromagnetic energy source, and a photodetector. The body may be configured to receive an imaging medium cartridge. The electromagnetic energy source may be configured to direct a beam of electromagnetic energy toward a reflective surface of the imaging medium cartridge received by the body. The photodetector may configured to detect an angle of reflection of the beam of electromagnetic energy from the reflective surface, the angle of reflection based at least on a volume of imaging medium in the imaging medium cartridge.

In accordance with a further embodiment of the present disclosure, a method for determining a volume of imaging medium in a cartridge is provided. A movable housing portion may be configured to move in response to changes in a volume of imaging medium in the movable housing portion. A beam of electromagnetic energy may be projected onto a location of a beam-receiving photodetector, the beam-receiving location moving in response to movement of the movable housing portion such that the beam-receiving location is based at least on the volume of imaging medium on the movable housing portion.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Figure 1A:
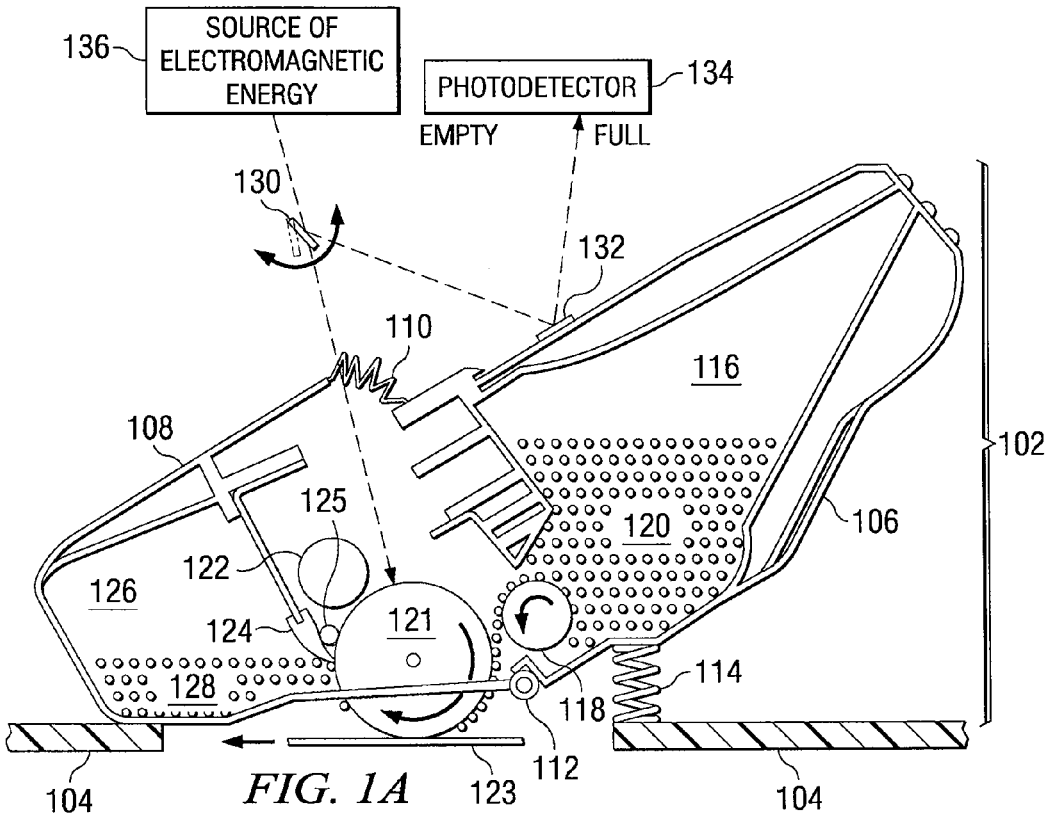
FIGS. 1A and 1B illustrate a cross-sectional view of an example toner cartridge for use in a toner-based imaging apparatus, in accordance with the present disclosure.
Figure 1B:
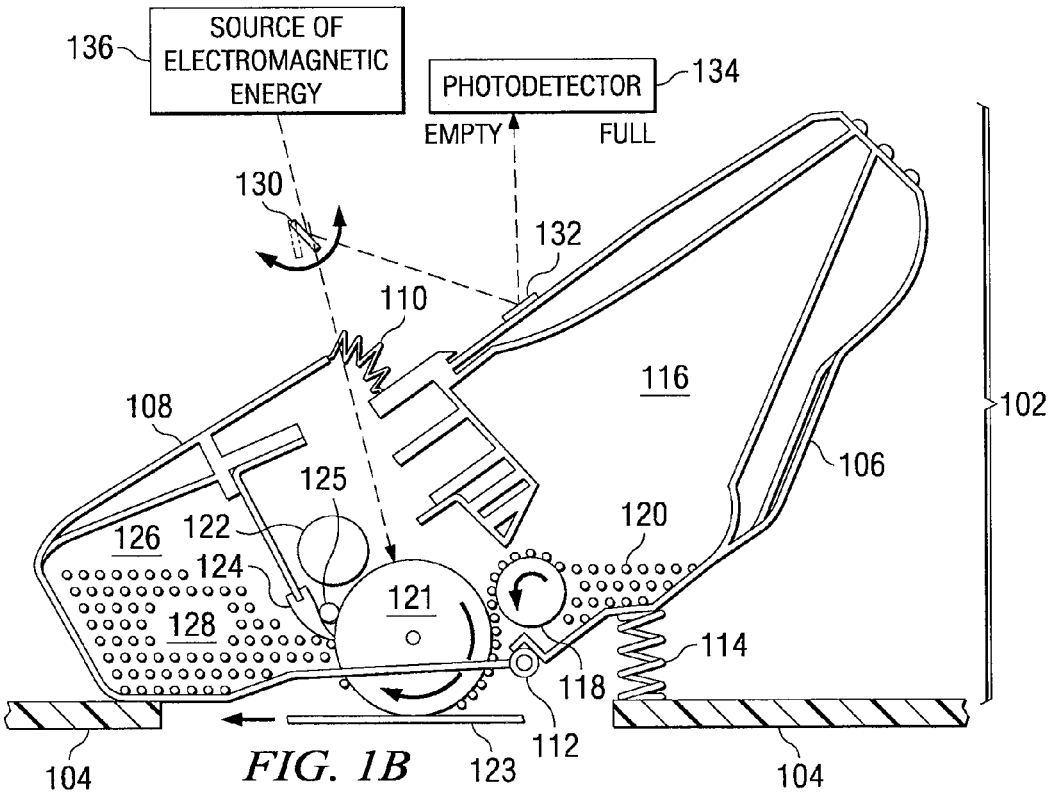
Figure 2:
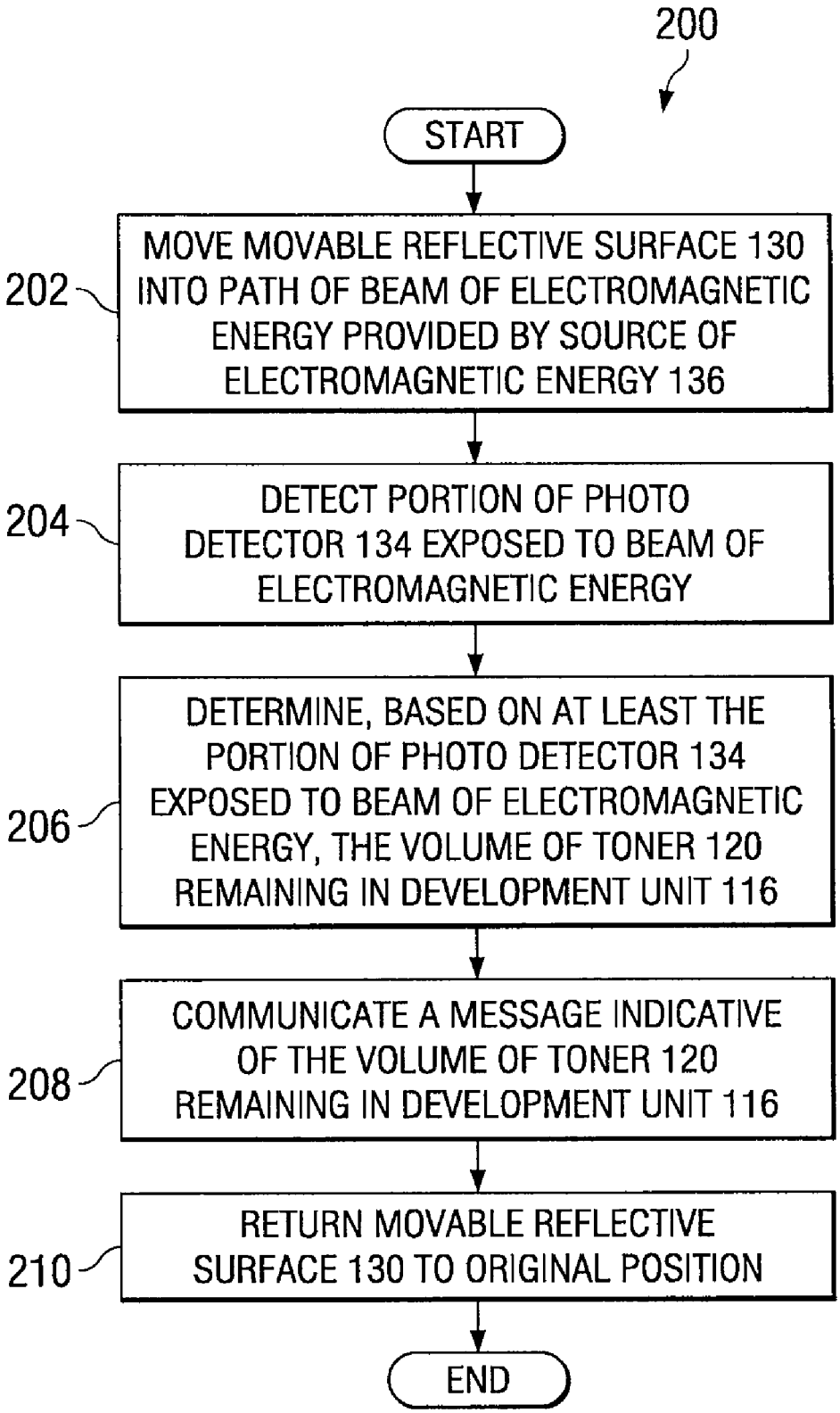
FIG. 2 illustrates a flow chart of an example method for determining the volume of imaging medium in a cartridge, in accordance with the present disclosure.

Preferred embodiments and their advantages are best understood by reference to FIGS. 1A, 1B and 2, wherein like numbers are used to indicate like and corresponding parts.

For the purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an information handling system may be a personal computer, a PDA, a consumer electronic device, a network storage device, or any other suitable device and may vary in size, shape, performance, functionality, and price. The information handling system may include memory, one or more processing resources such as a central processing unit (CPU) or hardware or software control logic. Additional components or the information handling system may include one or more storage devices, one or more communications ports for communicating with external devices as well as various input and output (I/O) devices, such as a keyboard, a mouse, and a video display. The information handling system may also include one or more buses operable to transmit communication between the various hardware components.

For the purposes of this disclosure, computer-readable media may include any instrumentality or aggregation of instrumentalities that may retain data and/or instructions for a period of time. Computer-readable media may include, without limitation, storage media such as a direct access storage device (e.g., a hard disk drive or floppy disk), a sequential access storage device (e.g., a tape disk drive), compact disk, CD-ROM, DVD, random access memory (RAM), read-only memory (ROM), electrically erasable programmable read-only memory (EEPROM), and/or flash memory; as well as communications media such wires, optical fibers, microwaves, radio waves, and other electromagnetic and/or optical carriers; and/or any combination of the foregoing.

FIGS. 1A and 1B illustrate a cross-sectional view of an example toner cartridge 102 for use in a toner-based imaging apparatus, in accordance with the present disclosure. As depicted in FIGS. 1A and 1B, toner cartridge 102 may comprise a movable housing portion 106 and a fixed housing portion 108. Movable housing portion 106 and fixed housing portion 108 may be coupled together via a hinge 112 and a flexible attachment 110, allowing movable housing portion 106 to pivot about hinge 112 with respect to fixed housing portion 108. In certain embodiments, flexible attachment 110 may include a hole or aperture to allow passage of electromagnetic energy provided by an electromagnetic energy source 136. As discussed above, toner cartridge 102 may be inserted into a toner-based imaging apparatus. While toner cartridge 102 is properly inserted into a toner-based imaging apparatus, fixed housing portion 108 may become fixed in relation to an imaging apparatus body 104, as depicted in FIGS. 1A and 1B. Also, while toner cartridge 102 is properly inserted into the toner-based imaging apparatus, movable housing portion 106 may be coupled to imaging apparatus body 104 via a potential energy source 114 (e.g., a spring), thus allowing movable housing portion 106 to "float" relative to imaging apparatus body 104.

Floating module 106 may include a development unit 116, a developer roller 118, and a reflective surface 132. Fixed module 108 may include a cleaner blade 124 and a cleaner unit 126. As depicted in FIGS. 1A and 1B, cartridge 102 may also include a drum 121, a charge roller 122 and a discharge lamp 125. Development unit 116 may generally include any reservoir or container configured to hold an imaging medium, e.g., toner 120. Cleaner unit 126 may be configured to hold unused and/or contaminated imaging medium, e.g., waste toner 128.

In operation, drum 121 of a toner-based imaging apparatus may be charged using a corona wire, primary charge roller, and/or any other suitable system, device or apparatus operable to project an electrostatic charge onto drum 121. In the embodiment depicted in FIGS. 1A and 1B, a charge roller 122 may be used to project electrostatic charge onto drum 121. Drum 121 may rotate while a beam from an electromagnetic energy source 136 (e.g., a laser, light emitting diode, and/or other suitable electromagnetic energy source) may be directed onto drum 121. The beam of electromagnetic energy 136 may turn on and off such that drum 121 is exposed to a pattern corresponding to an image to be imaged onto a recording medium 123. Accordingly, the portions of drum 121 exposed to beam of electromagnetic energy may lose their electrostatic charge, leaving an "image" of static electricity on drum 121 corresponding to the image to be imaged onto recording medium 123. Developer roller 118 may transfer particles of toner 120 from development unit 116 to drum 121, where particles of toner 120 may adhere to those portions of drum 121 where electrostatic charge remains. As a recording medium 123 passes by drum 121, drum 121 may transfer toner 120 onto recording medium 123, thus creating an image. One or more other components of the toner-based imaging apparatus may provide heat to fuse toner particles to recording medium 123.

Particles of toner 120 adhering to drum 121 which are not transferred to recording medium 123 may be cleaned from drum 121 via cleaner blade 124 and deposited in cleaner unit 126 as waste toner 128. Discharge lamp 125 may then expose drum 121 to electromagnetic energy to remove electrostatic charge from drum 121. In certain embodiments, a discharge roller may be used in place of discharge lamp 125.

As images are produced by the imaging apparatus, toner 120 may deplete from development unit 116. Consequently, the weight of the toner 120 remaining in development unit 116 may decrease as toner 120 is depleted. Such decrease in weight may decrease a compressive force exerted on potential energy source 114 by floating module 106. As the weight of toner 120 decreases and the compressive force of floating module 106 on potential energy source 114 decreases, potential energy source 114 may in effect push floating module 106 upward, such that it rotates relative to fixed module 108 about hinge 112. Such rotation may also cause floating module 106 to move relative to imaging apparatus body 104 and/or other components of an imaging apparatus.

To detect movement of floating module 106 associated with the depletion of toner 120, a reflective surface 132 may be disposed on floating module 106 and used in connection with a movable reflective surface 130, electromagnetic energy source 136, and a photodetector 134. Movable reflective surface 130 may include any surface (e.g., a mirror) that reflects all or a portion of electromagnetic energy provided by electromagnetic energy source 136. In certain embodiments, movable reflective surface 130 may be movable (e.g., by pivoting, sliding, or other movement), such that in one position, movable reflective surface reflects electromagnetic energy toward reflective surface 132, while in another position, allows electromagnetic energy to pass toward drum 121 without reflection.

Reflective surface 132 may include any surface that reflects all or a portion of electromagnetic energy reflected from movable reflective surface 130 toward photodetector 134 (e.g., a mirror). Photodetector 134 may include a chemical photodetector, photoresistor, light dependenent resistor, photovoltaic cell, photodiode, photomultiplier, phototube, phototransistor, and/or any other system, device, or apparatus operable to sense and/or detect light and/or other electromagnetic energy, and convert such detected electromagnetic energy into one or more electrical signals.

In certain embodiments, photodetector 134 may include or may be communicatively coupled to logic embodied in hardware, software, or a combination thereof to further process such electrical signals. In the same or alternative embodiments, photodetector 134 may be communicatively coupled to an interface (e.g., an LED indicator, a speaker, graphical user interface on an information handling system coupled to the imaging apparatus, and/or suitable human-detectable interface) that indicates the volume of toner 120 remaining in cartridge 102. In the same or alternative embodiments, photodetector 134 may be communicatively coupled to a gauge that indicates a percentage and/or amount of remaining toner.

In certain embodiments, one or more of movable reflective surface 130, photodetector 134 and electromagnetic energy source 136 may be integral parts of an imaging apparatus. In addition, one or both of movable reflective surface 130 and photodetector 134 may be integral parts of cartridge 102.

In operation, movable reflective surface 130 may be moved into the path of a beam of electromagnetic energy provided by electromagnetic energy source 136. Movable reflective surface 130 may direct such beam toward reflective surface 132, which in turn may direct such beam toward photodetector 134. Because the position of floating module 106 may vary based on the volume (and thus weight) of toner 120 remaining, the angle of reflection of the beam of electromagnetic energy from reflective surface 132 may vary based on the volume of toner 120 remaining. For example, if the amount of toner 120 remaining in development unit 116 is at full capacity, the beam of electromagnetic energy may strike photodetector 134 near the portion labeled "full" as shown in FIG. 1A. On the other hand, if the amount of toner 120 remaining in development unit 116 is at low capacity, the beam of electromagnetic energy may strike photodetector 134 near the portion labeled "empty" as shown in FIG. 1B. Consequently, the portion of photodetector 134 exposed to the electromagnetic energy reflected by reflective surface may depend on the volume of toner 120 remaining. Thus, by determining which portion of photodetector 134 is exposed to the beam of electromagnetic energy, the volume of remaining toner 120 may determined.

Although FIGS. 1A and 1B depict that the electromagnetic energy incident upon photodetector 134 is provided initially by electromagnetic energy source 136, a electromagnetic energy source other than electromagnetic energy source 136 may be utilized. In embodiments utilizing a separate electromagnetic energy source, a fixed reflective surface may be substituted for movable reflective surface 130. Additionally, in certain embodiments, an electromagnetic energy source may be substituted for reflective surface 132, wherein the electromagnetic energy source may provide electromagnetic energy directly to a portion of photodetector 134 based on at least the remaining volume of toner 120.

FIG. 2 illustrates a flow chart of an example method 200 for determining the volume of imaging medium 120 in a cartridge 102, in accordance with the present disclosure. According to one embodiment, method 200 preferably begins at step 202. As noted above, teachings of the present disclosure may be implemented in a variety of configurations of cartridge 102. As such, the preferred initialization point for method 200 and the order of the steps 202-210 comprising method 200 may depend on the implementation chosen.

At step 202, reflective surface 130 may be moved into the path of a beam electromagnetic energy provided by electromagnetic energy source 136, such that the beam may reflect off of reflective surface 132 and onto photodetector 134. Such movement may occur as a result of any suitable mechanical means. In certain embodiments, such movement may occur in response to a command or request to determine the volume of toner 120 remaining, the command or request originated from an imaging apparatus and/or an information handling system communicatively coupled thereto. At step 204, photodetector 134 and/or associated logic may detect a portion of photodetector 134 exposed to the reflected beam electromagnetic energy. At step 206, photodetector 134 and/or associated logic may determine, based on at least the portion of photodetector 134 exposed to the beam electromagnetic energy, the volume of toner remaining in development unit 116. At step 208, the imaging apparatus and/or an information handling system communicatively coupled thereto may communicate a message indicating the volume of toner 120 remaining development unit 116 (e.g., LED and/or other visual alert, alarm and/or other audible alert, message and/or alert displayed on an interface of the imaging apparatus and/or an information handling system communicatively coupled thereto). At step 210, movable reflective surface 130 may be returned to its original position, allowing electromagnetic energy to strike drum 121 to facilitate imaging on recording media 123.

Although FIG. 2 discloses a particular number of steps to be taken with respect to method 200, method 200 may be executed with greater or lesser steps than those depicted in FIG. 2. In addition, although FIG. 2 discloses a certain order of steps to be taken with respect to method 200, the steps comprising method 200 may be completed in any suitable order. For example, in certain embodiments, step 208 may execute immediately before, after or substantially contemporaneous with step 210.

Method 200 may be implemented using an information handling system, an imaging apparatus, and/or any other system operable to implement method 200. In certain embodiments, method 200 may be implemented partially or fully in software embodied in computer-readable media.

Additionally, while FIGS. 1A, 1B and 2 depict an imaging medium cartridge 102 housing toner 120 for use in a toner-based imaging apparatus (e.g., laser printer or LED printer) and a method for using same, methods and systems similar and/or identical to those discussed in this disclosure may be applied to other types of imaging apparatuses, including without limitation liquid inkjet imaging apparatuses, solid ink imaging apparatuses, and dye-sublimation imaging apparatuses.

Using the methods and systems disclosed herein, problems associated with conventional approaches to determining the volume of imaging medium remaining in a cartridge may be improved, reduced, or eliminated. For example, the methods and systems disclosed herein provide detection methods and systems requiring very few relatively inexpensive components, and may also leverage existing components of imaging apparatuses (e.g., sources of electromagnetic energy already present in toner-based imaging apparatuses).

Although the present disclosure has been described in detail, it should be understood that various changes, substitutions, and alterations can be made hereto without departing from the spirit and the scope of the disclosure as defined by the appended claims.

What is claimed is:

1. An imaging medium cartridge for use in an imaging apparatus, comprising:

a movable housing portion including a volume of imaging medium, the movable housing portion configured to move in response to changes in the volume of imaging medium in the movable housing portion; and a device coupled to the movable housing portion and configured to project a beam of electromagnetic energy onto a location of a beam-receiving photodetector, the beam-receiving location moving in response to movement of the movable housing portion such that the beam-receiving location is based at least on the volume of imaging medium on the movable housing portion.

2. An imaging medium cartridge according to claim 1, the device comprising one of: a reflective surface, a laser, and a light-emitting diode.

3. An imaging medium cartridge according to claim 2, the device comprising a first reflective surface in optical communication with an electromagnetic energy source via a second reflective surface, wherein:

the electromagnetic energy source provides electromagnetic energy to one or more photosensitive imaging components of a toner-based imaging apparatus; and the second reflective surface is configured to transmit electromagnetic energy from the electromagnetic energy source to the first reflective surface in connection with determining the volume of imaging medium in the movable housing portion.

4. An imaging medium cartridge according to claim 1, wherein the movable housing portion is coupled to an imaging apparatus via a potential energy source and is further configured to move relative to the imaging apparatus as the volume of imaging medium in the movable housing portion changes.

5. An imaging medium cartridge according to claim 1 further comprising a fixed housing portion configured to be fixedly coupled to an imaging apparatus and movably coupled to the movable housing portion.

6. An imaging medium cartridge according to claim 5, the fixed housing portion configured to house waste imaging medium.

7. An imaging medium cartridge according to claim 1, the imaging medium comprising at least one of:

toner, for use in a toner-based imaging apparatus;

liquid ink, for use in an inkjet imaging apparatus;

solid ink, for use in a solid ink imaging apparatus; and dye, for use in a dye-sublimation imaging apparatus.

8. An imaging apparatus comprising:

a body configured to receive an imaging medium cartridge;

an electromagnetic energy source configured to direct a beam of electromagnetic energy toward a reflective surface of the imaging medium cartridge received by the body; and a photodetector configured to detect an angle of reflection of the beam of electromagnetic energy from the reflective surface, the angle of reflection based at least on a volume of imaging medium in the imaging medium cartridge.

9. An imaging apparatus according to claim 8, the electromagnetic energy source comprising one of a laser and a light-emitting diode.

10. An imaging apparatus according to claim 8, the electromagnetic energy source further configured to provide electromagnetic energy to one or more photosensitive imaging components of a toner-based imaging apparatus.

11. An imaging apparatus of claim 10, the one or more photosensitive imaging components comprising a photosensitive drum.

12. An imaging apparatus according to claim 8, wherein the body is configured to be coupled to a portion of the imaging medium cartridge via a potential energy source, such that the portion moves relative to the body in response to changes in the volume of imaging medium.

13. An imaging apparatus according to claim 8, further comprising a second reflective surface configured to direct the beam of electromagnetic energy from the electromagnetic energy source toward the reflective surface of the imaging medium cartridge received by the body.

14. An imaging apparatus according to claim 13, the second reflective surface configured to move between a first position and a second position, the first position allowing the beam of electromagnetic energy to bypass the second reflective surface, and the second position allowing the beam of electromagnetic energy to direct the beam of electromagnetic energy from the electromagnetic energy source toward the reflective surface of the imaging medium cartridge received by the body.

15. An imaging apparatus according to claim 8, the imaging medium cartridge comprising at least one of:

toner, for use in a toner-based imaging apparatus;

liquid ink, for use in an inkjet imaging apparatus;

solid ink, for use in a solid ink imaging apparatus; and dye, for use in a dye-sublimation imaging apparatus.

16. A method for determining a volume of imaging medium in a cartridge, comprising:

configuring a movable housing portion to move in response to changes in a volume of imaging medium in the movable housing portion; and projecting a beam of electromagnetic energy onto a location of a beam-receiving photodetector, the beam-receiving location moving in response to movement of the movable housing portion such that the beam-receiving location is based at least on the volume of imaging medium on the movable housing portion.

17. A method according to claim 16, wherein directing the beam of electromagnetic energy from the module comprises:

generating the beam of electromagnetic energy by an electromagnetic energy source; and reflecting the beam of electromagnetic energy from a reflective surface disposed on the module toward the photodetector.

18. A method according to claim 17, further comprising:

moving a second reflective surface into the path of the beam of electromagnetic energy; and reflecting the beam of electromagnetic energy from the second reflective surface toward the reflective surface disposed on the module.

19. A method according to claim 17, wherein the electromagnetic energy source is configured to provide electromagnetic energy to one or more photosensitive imaging components of a toner-based imaging apparatus.

20. A method according to claim 16, wherein providing the electromagnetic energy to the imaging apparatus comprises coupling the module to the imaging apparatus via a potential energy source.

* * * * *